United States Patent [19]

Drapp

[11] 4,410,038

[45] Oct. 18, 1983

[54] INTERMITTENT WELL CONTROLLER

[75] Inventor: Donald J. Drapp, Missouri City, Tex.

[73] Assignee: Daniel Industries, Inc., Houston, Tex.

[21] Appl. No.: 373,132

[22] Filed: Apr. 29, 1982

[51] Int. Cl.[3] ..... F21B 43/00

[52] U.S. Cl. ..... 166/53; 166/64; 417/57

[58] Field of Search ..... 166/53, 64, 65 R, 66–68, 166/372; 417/56–59

[56] References Cited

U.S. PATENT DOCUMENTS

| | | | |
|---|---|---|---|
| 3,012,513 | 12/1961 | Knox | 417/57 |
| 3,095,819 | 7/1963 | Brown et al. | 417/57 |
| 3,276,469 | 10/1966 | Storm et al. | 166/53 |
| 3,351,021 | 11/1967 | Moore, Jr. | 417/57 |
| 3,941,511 | 3/1976 | Morgan | 417/58 X |
| 4,211,279 | 7/1980 | Isaacks | 166/64 |
| 4,215,746 | 8/1980 | Hallden et al. | 166/53 |
| 4,267,885 | 5/1981 | Sanderford | 166/53 X |
| 4,352,376 | 10/1982 | Norwood | 166/53 X |

*Primary Examiner*—Ernest R. Purser
*Assistant Examiner*—Thuy M. Bui
*Attorney, Agent, or Firm*—Gunn, Lee & Jackson

[57] ABSTRACT

An intermittent well controller is disclosed. In the preferred and illustrated embodiment, the controller, in conjunction with sensors indicative of well conditions, controls the delivery of lifting gas to the well. The controller is intended to be installed at a remote location where the equipment is normally provided with no commercially available electrical power and is battery operated. The battery operated controller is normally switched off nearly all the time. Moreover, the controller incorporates a battery sensitive indicator which signals an alarm in the event that terminal voltage of the battery cells drops below a specified level to provide a warning for service personnel on their next trip to the well that the batteries should be replaced. Further, the device utilizes a computer with a memory not subject to erasure when the equipment is switched off. The device is cycled on for a short interval of time, typically just a few microseconds. The duty cycle is thereby far less than 1%. It is cyclically switched on to test for a change of conditions at a timed rate. Moreover, the device utilizes a two-way three port solenoid operated non-return pilot valve with detent action so that the valve is operated only by a short pulse, and does not require the continuous application of power. The valve maintains the last achieved position.

11 Claims, 2 Drawing Figures

INTERMITTENT WELL CONTROLLER

BACKGROUND OF THE DISCLOSURE

This disclosure is directed to a controller to be used with various types of gas lift wells including a piston lift producing well. The controller works well with a well which produces oil or gas or both. The typical well incorporates a casing and a tubing string in the casing. In one mode of production, a piston in the tubing string is permitted to travel from bottom to top lifting a slug of oil above the piston. It is lifted by injecting gas below the piston. The piston, therefore, functions as a pump piston on the upstroke. When the piston reaches the top, it is permitted to fall back to the bottom to gather another slug of oil. This procedure ordinarily requires the injection of surface gas into the casing, or perhaps into a string of macaroni pipe adjacent to the production tubing string. Alternate gas lift production techniques include gas lift wells, both continuous and intermittent with or without gas lift valves.

This controller responds to a number of well conditions detected by sensors. The well conditions include arrival of the piston at the top end. Other conditions also include casing pressure and production tubing pressure. These pressure levels are indicative of the operative condition of the well and in particular whether or not it is ready to deliver a slug of oil. In other production procedures, the well head sensors respond to conditions to signal the device of this disclosure. This invention is a controller typically installed on a well at a remote location where electrical power is not readily available. The device is normally installed in a housing at the well head. This environment is normally dangerous because natural gas may escape in the near vicinity. The device of this disclosure utilizes relatively low voltage batteries so that the device is intrinsically safe in that kind of atmosphere. The safety of this device is indicated by the fact that the device does not form sparks which might ignite natural gas in the near vicinity.

There are several problems relating to the use of this device, and the novel and unobvious controller of this disclosure has overcome these problems. One problem that has been overcome and, hence, one advantage of this apparatus is the use of a battery supply coupled with a battery voltage monitor. This monitor forms a signal indicated on a visible display alerting service personnel to the fact that batteries need replacing. Preferably, the device is set at a very high level so that only a slight drop in terminal voltage triggers the alarm in operation. While there might be many more weeks or months of life in the batteries, field service personnel happening by will observe the signal and replace the batteries prior to failure. This early warning system prevents the well from being poorly operated as a result of battery failure.

Another problem overcome by this apparatus and, hence, another feature of this disclosure is the use of a CMOS 8 bit microcomputer which is operated with a duty cycle of far less than 1%. The device is, for all intents and purposes, switched off. It is equipped with a non-volatile memory. The microcomputer and its associated memory are thus in an off state most of the time and require nil power to maintain this condition. The device is switched on occasionally by a timing circuit which causes it to cycle on at which time the variables from the sensors are tested to determine the operative state of the well. If it is determined that the equipment should be switched to thereby change a valve and alter operation of the well, a pilot valve for the main control valve is operated by pulsed solenoids. The pilot valve does not require the continued application of power; rather, it is switched on only by pulses. When it is on, it operates for only an interval. This interval is in the millisecond range but it is sufficient to change the operative state of the pilot valve.

This device, thus, comprises a relatively small apparatus typically fitting within an enclosure of about 200 cubic inches or less. This enclosure houses a battery pack, the controller of this disclosure and the output pilot valve. It is nicely reduced in size to enable full enclosure within a single housing for safety sake. Moreover, it operates at low voltages and, therefore, is intrinsically safe from explosion. The device further utilizes a battery pack for remote field installations. It further features non-volatile memory and CMOS microcomputer components which enable the components to be switched off in a duty cycle which is far less than 1%.

Many other features and objects of this structure will be observed upon a review of the detailed disclosure which is included below.

BRIEF DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1:
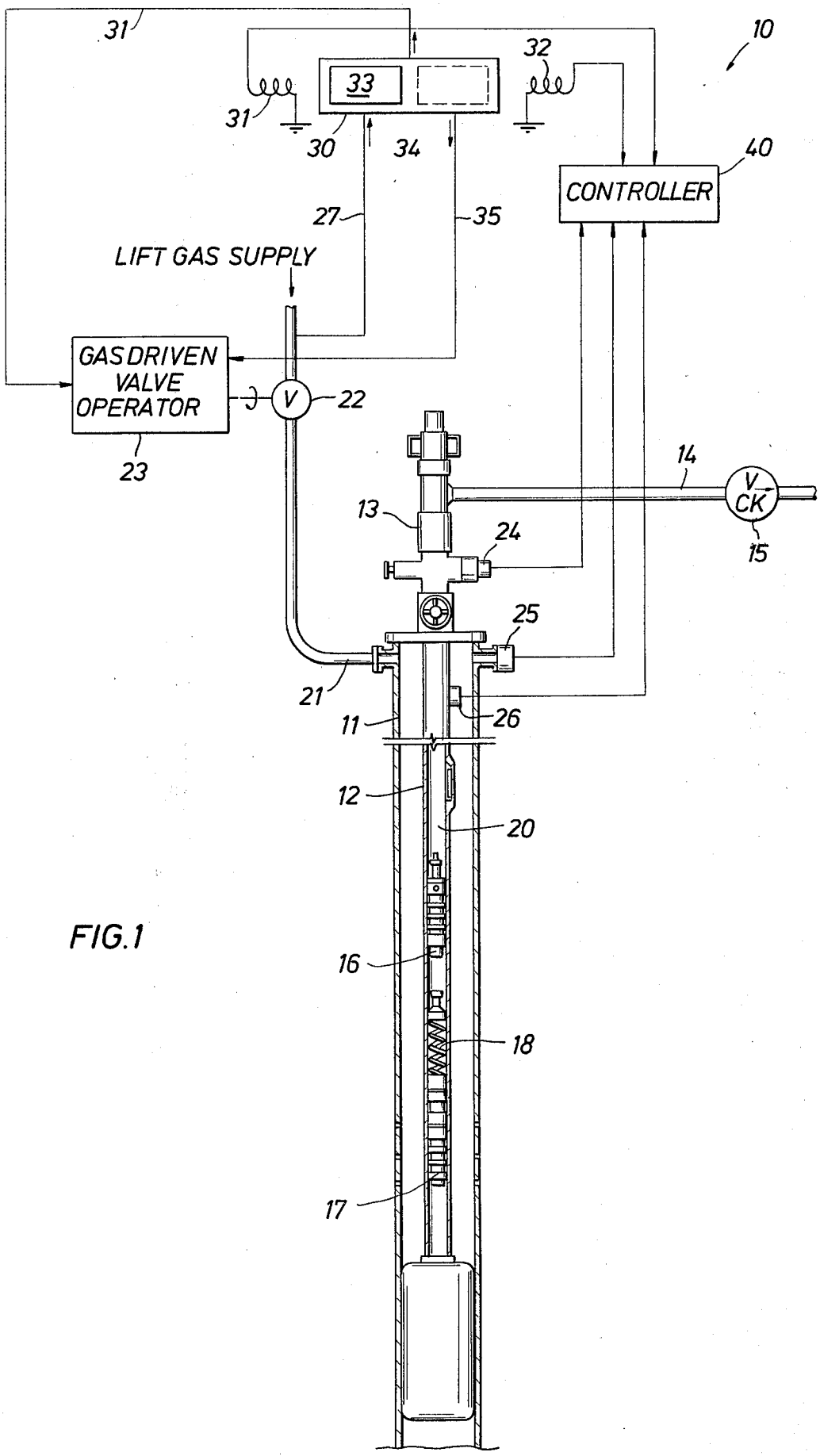
FIG. 1 discloses the conroller of this disclosure installed on a gas lift well incorporating a casing and tubing string wherein a piston lifts a slug of oil on injection of gas below the piston.

Attention is first directed to FIG. 1 of the drawings. In FIG. 1, the numeral 10 identifies the controller of this apparatus. Its installation with the other equipment will be set forth first to provide the context in which the controller 10 operates. The controller operates with wells having well head sensors to determine the operative status of the well. One example is a piston lift well produced intermittently. Another example is a gas lift well using intermittent gas injection. Other examples will be mentioned. FIG. 1 sets out an exemplary installation.

A completed well having casing 11 extends to a producing formation. The casing is perforated to enable oil or oil and gas from the formation to flow into the casing. The casing further encloses a tubing string 12 within the casing. The tubing string opens into the lubricator 13 at the top of the well. The well head equipment includes at least the lubricator and the other valves necessary for operation of the well. The lubricator has a Tee which connects to a flow line 14 to deliver the produced oil and gas through a check valve 15. Moreover, the lubricator 13 limits travel of a piston 16 which moves against the lubricator when the piston travels to the upper extremity of movement permitted along the tubing string. The tubing string terminates at a standing valve 17 at the lower end. The standing valve limits escape of oil from the tubing string. Oil is forced by formation pressure into the tubing string and rises in the tubing 12 to a level determined by formation pressure, depth of the well and other factors. The standing valve admits oil through a check valve. The standing valve 17 supports a bottom hole bumper spring 18. This is a shock absorber to permit the piston 16 to bounce without damage. The piston travels upwardly with minimum leakage. It falls down the tubing with blowby, thereby falling downwardly through any accumulated oil and gas in the bottom part of the tubing string. The piston, thus, is expanded for upward travel and it is forced upwardly, lifting a slug of oil on top. The slug of oil is identified by the numeral 20. The oil 20 may be further lifted by injecting gas from one or more gas lift valves, one being shown in a side pocket in the tubing.

Production is obtained by introducing lift gas from a lift gas supply line 21. This line communicates with a source of gas and a compressor, as required, to introduce lifting gas into the casing annulus. An alternative form of delivering the gas is to install a macaroni string from the lift gas inlet to the bottom hole location, at which point, the lift gas is injected beneath the piston. Whatever the case, pressurized lift gas is introduced into the tubing string. This pressure is observed in the casing where this route is chosen. Otherwise, it can be measured at various points in the macaroni string location within the casing. The lift gas forces oil from the casing into the tubing string through the standing valve. This oil is accumulated in the slug 20 above the piston. The rate of accumulation depends on a number of scale factors including the rate of production from the formation and the relative back pressure maintained within the casing. The lift gas supply flows through a control valve 22. This typically is a large valve. The valve can be hand operated and in addition, it is also operated by a gas driven valve operator 23. A sequence of operation might best illustrate functioning of the device. Assume, as a beginning condition, that the valve 22 is closed. The piston 16 is resting at the bottom on the bumper spring 18. Oil flows from the formation through the perforations and into the tubing string. A slug of oil 20 is accumulated and stands one hundred feet above the piston 16. The oil enters the tubing string through the standing valve and is prevented from leaking back out of the tubing string. Moreover, the slug of oil accumulates above the piston to be subsequently lifted by the piston.

The valve 22 is opened. This introduces higher pressure lift gas through the line 21 and into the casing 11. As pressure within the casing increases, the pressure increases in the tubing string 12 below the piston 16. The piston 16 is forced upwardly. It is forced up and lifts the slug of oil on top of the piston. The piston is then stroked from the bottom most location until it travels into the lubricator 13. This stroke forces the oil out of the tubing string and into the flow line 14. Piston movement has the form of a very long piston stroke. The production of oil in this method resembles a pumping action utilizing the conventional sucker rod and bottom located pump. The differences, however, are quite notable; the stroke can be several thousand feet from the bumper spring 18 until the piston arrives at the lubricator. At this juncture, the piston ordinarily operates to reduce its diameter or to open a flow path through the piston. This enables the piston to drop because the piston no longer holds pressure. At this time, it is probably wise to switch off the gas lift valve 22. This tends to reduce pressure in the casing and enable additional oil to flow from the formation for eventual accumulation above the piston. The piston falls back from the top until it returns to the bottom most position. There, the piston then accumulates another slug of oil over the piston and is ready for another cycle or trip.

The novel controller set forth herein responds to selected variables. Normally, the variables of interest include passage of the piston 16. This is indicated by a transducer 24 installed near the well head or even at the lubricator 13. In addition, casing pressure is a significant factor in most instances, and a pressure transducer 25 is installed on the casing at a suitable location to indicate this pressure. Last of all, tubing pressure is sensed by a tansducer 26 and is also signaled for the controller. These three variables ordinarily provide information sufficient to inform the controller of the operative state of the well and the location of the piston 16.

The lift gas supply line 21 is tapped with a pilot line 27. This is input to a two-way three port valve 30. The valve of this disclosure is operated by a pair of opposing solenoids 31 and 32. They are ideally wound with a large number of turns and respond to a relatively low voltage pulse. The valve element 33, located within the valve, maintains one of two positions. It is moved towards one or the other of the solenoids. It is maintained in that position even when the solenoids are switched off. To this end, a detent 34 holds the element in the last achieved operative condition. The detent positions the valve element 33 at a location determined by operation of the solenoids, and the flow from the line 27 is thus switched. The detent 34 can be a protruding member in the path of the valve element 33. An alternate form of detent can be the friction resisting movement of the valve element. In fact, the preferred embodiment, installed horizontally, is held at the achieved location by friction and a detent is not necessary.

The pilot valve 30 alternately may be spring returned to close, pulse operated to open, and pulse operated to release a detent to close. The choices between solenoid coils, gas driven operators, return springs, detents or piston holding devices are dependent on installation details and can be varied. The line 27 inputs lift supply gas at an elevated pressure to be ouput through the line 35. It is supplied to the gas driven valve operator 23. Conversely, the valve element 33 moves to the opposite position on the other side of the detent. In this position, the supply line 27 is connected to the outlet line 36 which, in turn, connects to the gas driven valve operator 23. The operator 23 is thus driven by gas from the lines 35 or 36 to fully open or close the valve 22. It is driven to one extreme or the other. It opens the valve 22 either fully or closes the valve. By means of the application of short DC pulses to the solenoids 31 and 32, the pilot valve 30 is switched from one state to the other. Continued electrical power is not required to sustain the operative state of the valve 30. Rather, a single pulse operates the valve 22 in the desired direction for an extended interval of time to save electricity. Indeed, the valve 22 is left open or closed indefinitely until operated again by movement in the opposite direction.

Figure 2:
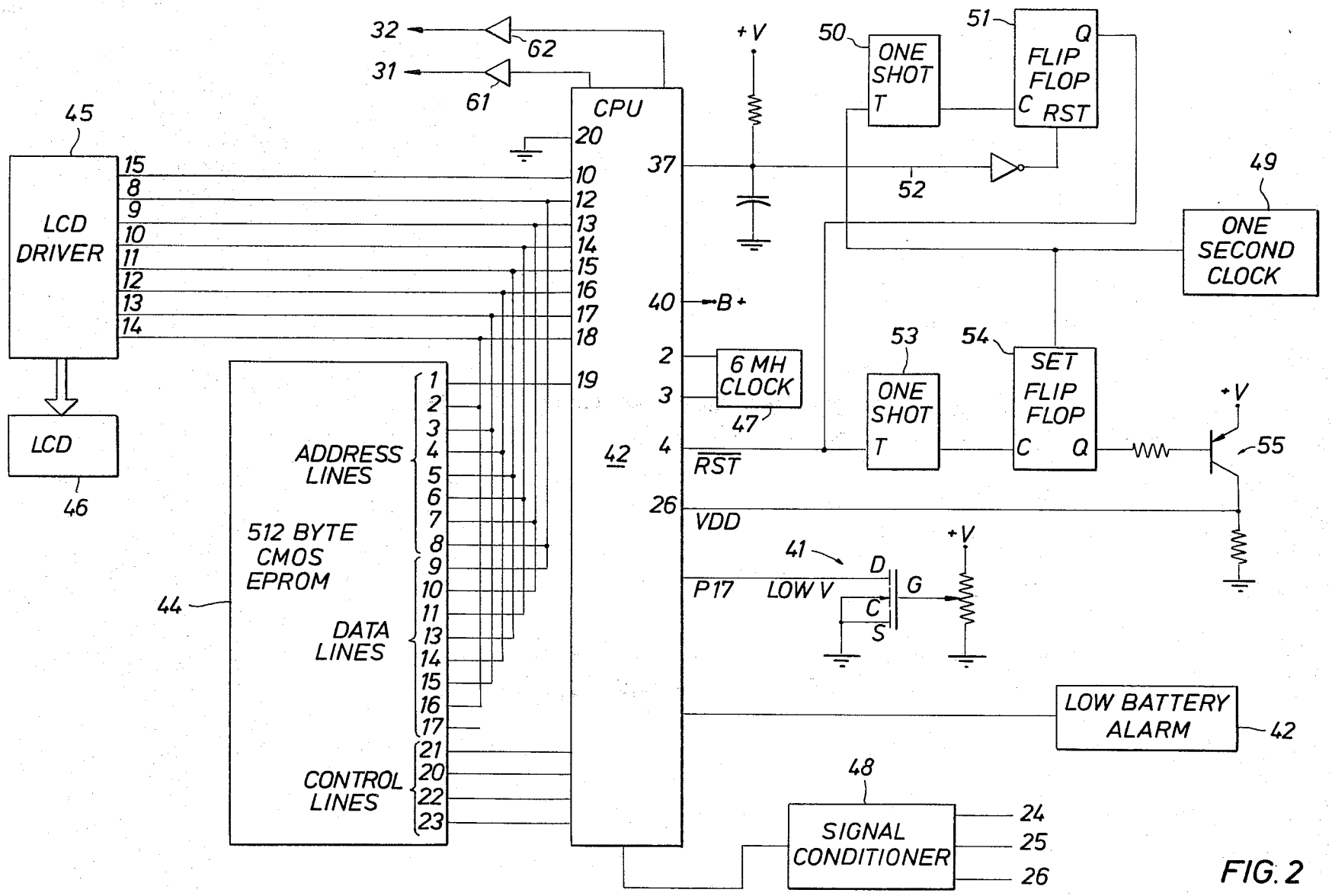
FIG. 2 is a schematic of a portion of the circuitry of the controller of this disclosure.

The numeral 40 identifies a controller which is better illustrated in schematic form in FIG. 2 of the drawings. There, the controller 40 is illustrated in schematic form. The controller 40 includes a battery monitoring apparatus. This is in the form of a critically biased FET transistor 41 having a gate voltage from the system battery. If battery voltage drops below a set voltage, a low voltage signal is formed and a signal for low voltage alarm is sent. The low voltage alarm is some suitable display, and one form is a LCD indicator message. An LCD is a low current device which signals, thereby informing service personnel that the battery voltage is low. It will be appreciated that batteries can be selected among the various types of batteries available which maintain terminal voltage for a fairly long interval. When the terminal voltage drops even so slightly to achieve cross-over as detected by the detector 41, this event is signaled. While the equipment will still operate at reduced voltage, the alarm is preliminary to final expiration of the batteries. This gives service personnel several days or weeks in which to observe the alarm signal. This enables the service personnel, on periodic maintenance trips to the well, to observe the signal and change out the batteries of the equipment. Assume fresh batteries furnish six volts. The alarm value might be 4.7 volts. Even then, the circuitry will operate as low as about 4.3 volts.

This apparaus utilizes a CMOS single chip 8 bit microcomputer. One suitable circuit is identified by Model No. PD80C35. This is a CMOS single chip 8 bit microcomputer including its internal RAM, I/O lines, and timer, and is readily compatible with added external memory. An alternate form with its own ROM is PD80C48. This microcomputer is similar in performance. It operates at a 2.5 microsecond cycle time when driven by a six megahertz clock source. Moreover, it comes in a forty pin configuration and operates at a nominal voltage supply of five volts. The current drain of the device is in the range of about 10 milliamperes during operation, and is substantially nil during standby. Moreover, the device is able to store data, and maintain the stored data even after power has been turned off. This device is identified at 42 in FIG. 2 of the drawings and functions with side board memory for the PD80C35, or internal memory for the PD80C48. The memory is 512 bits and is preferably fabricated of CMOS and is an EPROM separately identified by the numeral 44. The memory 44 is illustrated separately even though it may be in a common housing. It too can be switched off without destruction of the stored data. The memory 44 stores cycles of operation dependent on the number of trips of the piston, pressure signals, and other programmed variables and relationships for production control. Recall that the sensors preferably form binary data. To this end, the sensors may be reset to alter the pressure levels.

The microcomputer 42 has several outlet lines which connect with an LCD driver 45 which, in turn, connects with an LCD display 46. These components provide visual indications upon demand. As will be observed, the microcomputer 42 is connected to a clock 47 which provides an external source of timing pulses for its operation.

The microcomputer 42 is ordinarily switched off. It is switched on only periodically. When switched on, it samples the three input variables from the transducers 24, 25 and 26. It forms a control signal based on those variables. Those variables are thus input to a signal conditioner 48 which, in turn, forms signals for the microcomputer 42 when variables measured by the transducers have indicated a significant change. For instance, one change is the arrival of the piston. Assume that this is tested periodically, and once per second is more than adequate. The signal conditioner 48 thus forms a signal indicative of transducer formation, and is interrogated every second. This is fast, at least in light of the dynamics of the mechanical system providing the input through the transducers 24, 25 and 26. A sampling rate of one second has been determined to be adequate. The sampling rate could be faster or slower depending on the dynamics of the system. The sampling rate involves setting a clock rate, as for instance, replacing a crystal in a clock oscillator. A clock 49 forms a true pulse at a periodic rate of one per second. The initial condition of the microcomputer 42 is switched off. It is in the standby state. It is not able to operate until it is provided with operative power. Operative power, for its operation, is input through the pin 26. When the pin 26 is provided with a nominal voltage of five volts, normal operation is enabled. Conversely, when this voltage level is not attained, the processor enters the standby mode and thereby markedly reduces its current drain to a standby current level in the microampere range.

The clock 49 is thus set to form a pulse every second. This pulse has a duration of some arbitrary length, typically 20 to 50 microseconds. The pulse is input to the trigger input of a one shot multi-vibrator 50. This formed a timed pulse which is output to a flip-flop 51. The flip-flop 51 forms a delayed pulse. The end of transaction signalled by the microcomputer 42 is output on a line 52 from terminal 37, is inverted, and applied to the reset terminal of the flip-flop 51. The flip-flop 51 forms a time delayed signal which is input to another one shot multi-vibrator 53. That is, in turn, supplied to a flip-flop 54. An output pulse is formed from that and applied to the gate of a switching transistor 55. This is a time delayed wave form. More importantly, this wave form is applied is to the power input terminal at 26 on the microcomputer 42. This inputs the necessary operative voltage for the microcomputer. This enables the microcomputer 42 to operate for an interval. It is operated for an interval sufficiently long to enable it to examine the input signal from the signal conditioner 48.

If there is an operative change of significance measured by any of the sensors 24, 25 or 26, this change is input to the microcomputer 42. It then determines whether or not the valve in the gas supply line should be opened or closed. Once a cycle of operation has been finished, this event is identified by a signal from pin 37 supplied through the line 52 for resetting the flip-flop 51. Power for operation of the microprocessor is thus furnished during the operation of the microprocessor is thus furnished during the positive going portion of the wave form 55. Since the duty cycle is 1% or less and occurs every second (dependent on the clock 49), and the sensors are sampled periodically in real time operation with minimum power consumption. The sampling rate is sufficiently fast that the operation of the system occurs in real time.

The microcomputer thus examines the data from the signal conditioner 48, and forms instructions for the solenoids. These instructions are in the form of pulses which are output through the control lines from the microcomputer 42 through pulse amplifiers 61 and 62.

They amplify the control pulses and provide relatively short pulses for operation of the two solenoids.

An Example of Operation

Operation of the system should now be considered. Assume, for purposes of description, that the piston 16 is resting at the bottom. Assume further that the valve 22 has been closed. Assume also that a slug of oil 20 accumulates above the piston, and that the slug is sufficiently large that it should be then pumped to the surface and produced. Assume further that pressure in the tubing string is 100 p.s.i. while pressure in the casing is approximately the same. Assume further that the supply pressure is 1,000 p.s.i. Upon sensing both low pressures mentioned above and further determining that the piston 16 is not at the top, the microcomputer 42 tests these variables and determines that a cycle of operation should begin. The cycling rate (typically the number of trips of the piston 16 desired during a twenty-four hours period) is noted, and if it is time for the operation, a signal is then formed for the solenoid valve 30. This valve is operated to form a signal opening the control valve 30 to open the main valve 22. Supply gas is introduced into the casing through the supply valve 21. The gas introduced into the casing raises the pressure. As this rise in pressure occurs, gas is introduced into the lower parts of the casing also and eventually forces the piston 16 upwardly. Assume that there is minimal leakage from the casing, in which event the pressure in the casing will rise toward the supply level or approach 1,000 p.s.i. Depending on the weight of the slug of oil and other scale factors, pressure below the piston 16 becomes sufficient at some intermediate level to start forcing the piston upwardly. Assume that this is 500 p.s.i. When the pressure has been raised in the casing such that the pressure acting on the piston is 500 p.s.i., it begins to lift and is pressure forced up the tubing string 12 towards the lubricator 13. As more gas is introduced into the casing and increases casing pressure, the piston 16 travels upwardly. Its upward movement either reduces or at least retards the rate of increase of pressure in the casing. The piston is forced upwardly, carrying the slug of oil above it. As oil flows from the well, pressure in the casing does not rise above a selected level. As the last of the oil flows from the tubing, a pressure variation is noted and the piston sensor also forms a signal indicative of piston arrival.

After this cycle of oil lifting, the valve 22 is then closed. It is closed as a function of the three variables, typically when the piston 16 has arrived at the lubricator 13. A second and alternate condition is that pressure in the casing has reached some predetermined level such as 700 p.s.i. This level can be set as a safety factor; it can also be set knowing that a casing pressure of 700 p.s.i. will force the piston to the surface albeit the piston is still in route. The rate of piston travel, in part, depends on the weight of the slug of oil. Whatever the case, the pressure is also monitored as an override condition whereby pressure in the casing does not exceed some predetermined level. A third condition which might initiate closing of the valve 22 is that it has been open for a time interval sufficient to accomplish a trip by the piston. If that trip has not occurred and the interval has elapsed, it is indicative that a large volume of gas has been introduced into the casing for lift purposes but the trip has not been accomplished. That event may well imply a malfunction. Such a malfunction could occur if, for instance, the piston were snagged without completing the trip. If that is the case, subsequent introduction of more supply gas would not produce any more oil.

The controller 40 supervises operation of the valve 22. In the examples just given, the valve 22 is switched on at a particular point in time and is left open until a specified event does occur.

Assume, for purposes of description, that the valve 22 is opened and the piston 16 travels to the lubricator 13 and is sensed by the transducer 24. This forms a signal supplied to the controller 40 which, in turn, results in closure of the supply valve 22. When the supply valve 22 is closed, the lift cycle is terminated. At this point, the piston has moved the entire slug of oil into the flow line 14. The piston is then permitted to fall back to the bottom by operation of the piston. Recall that the piston either has a check valve permitting flow up through the piston, or alternately, the piston expands to lift oil and shrinks to fall in the tubing. The piston falls back to the bottom to pick up another slug of oil. It falls through any oil accumulated above the standing valve 17 and lands on the bumper spring 18. The shock of the fall is absorbed by the spring and the piston rests there until an additional column of oil is collected. While the valve 22 has now been closed for some time, pressure in the casing is reduced as oil is accumulated in the tubing string. Pressure in the casing drives oil into the tubing string. During the interval when the piston falls, pressure relief occurs through the tubing string. Using the numbers of the foregoing example, assume that maximum pressure in the casing was 600 p.s.i. when the valve 22 was closed. After the slug of oil has been delivered and the piston has begun to fall back into the tubing string, pressure in the casing is inevitably relieved to some lesser pressure. Whatever the value, it does drop. While it drops, the pressure in the tubing string drops even further depending on the back pressure of the supply line. This drop of pressure in the tubing string is enhanced by removing the slug of oil and dropping the pressure through the check valve 15 connected to the supply line 14. This pressure differential between casing and tubing assists the accumulation of another slug of oil in the tubing string. The rate of accumulation is a function of many variables. This can be observed on flowing the well when the well is periodically serviced whereby the controller 40 can then be instructed to operate cyclically a specified number of trips for the piston during each day. For instance, it may be determined that oil is produced at a rate sufficient to require eight trips per day, and the piston would, therefore, be cycled every three hours. Such instructions can be provided in memory whereby the microcomputer is operated every three hours. Each cycle of piston travel is thus initiated by opening the valve 22 periodically to restart the cycle of operation.

One important feature of this apparaus is the power conservation that is achieved. The equipment is really off most of the time, having a duty cycle of less than 1%. Battery drain is, therefore, minimal. Even so, the batteries will eventually fail. When they drop terminal voltage and approach the set level which has been determined by the detector 41, this event is signaled through the alarm. Assume that the batteries have a life of about ten to fifteen months in the field. They may operate for six to nine months before the low voltage alarm is signaled. Even at that point, the batteries can operate the equipment for several more months. On the next trip of service personnel, they will observe the low battery alarm signal and replace the batteries.

The piston can be operated at a rate which removes the optimum quantity of oil. If it is operated at a very minimal rate, the slug of oil to be lifted may be too heavy. On the other hand, if it is operated too often, the slug may be too small. Both would be wasteful of supply gas. The ideal arrangement is to determine the optimum rate of production of the well and to trip the piston sufficiently often to obtain the optimum production all in response to observed variables including casing pressure, piston passage and the like.

Alternate Production Techniques

Alternate production techniques can be controlled by the present apparatus. As an example, a series of gas lift valves can be used to lift by controlled introduction of lift gas into the well. The lift gas can be injected below the oil to be produced in response to measured pressure in the tubing or casing. Many production techniques can be used to produce wells in a variety of circumstances under control of the present intermittent controller.

The preferred embodiment cooperates with a plunger passage switch and two pressure switches. All three devices form binary signals. The controller preferably works best with binary input signals. Adjustments to the pressure settings can be implemented by changing the setting of the pressure responsive sensors. One version of equipment is the Murphy pressure switch which includes a pressure setting to enable altering the pressure setting of the device. In the control of wells operating without a plunger, the well data is best presented to the controller in the form of binary signals similar to the disclosed embodiment.

While the foregoing is directed to the preferred embodiment, the scope is determined by the claims which follow:

I claim:

1. For use in controlling the rate of production of a producing well on a gas lift system in response to operative conditions of the well which are determined by sensor means forming well condition signals indicative of the condition thereof, an apparatus which comprises a battery powered controller in a normally off state which is periodically switched on to test the well condition signals from said sensor means, and further including output means connected to said controller for forming a control signal for operation of the gas lift system and wherein said controller includes an integrated circuit microcomputer means switched on by a first means preventing application of adequate power for operation, cooperative with a second means periodically switching said microcomputer means on for an interval of time sufficient to operate a third means to obtain the well condition signals indicative of the well condition, and wherein said microcomputer means is on sufficiently long to determine the well condition and form the control signal from said output means.

2. The apparatus of claim 1 including a battery voltage monitor means forming an alarm signal on decline of battery voltage below a specified level.

3. The apparatus of claim 1 further including memory means for storing data for said microcomputer means for intervals when said microcomputer means are in the normally off state.

4. The apparatus of claim 3 including clock means forming a timed and periodic signal switching said first and second means repetitively to switch said microcomputer means on for a duty cycle of less than 1% of time which on cycle is sufficient to enable said microcomputer means to initiate and complete obtaining the well condition signals from said sensor means prior to ending the duty cycle.

5. The apparatus of claim 4 further wherein a signal conditioner means forms a conditioned signal for said microcomputer means from the well condition signals.

6. The apparatus of claim 5 further including a valve controller means operatively connected to a valve means for altering the operative condition of said valve means, and wherein said valve controller means is a pulse initiated circuit operating said valve means which operation is sustained even after a pulse applied thereto is ended.

7. The apparatus of claim 6 further including a pair of opposing pulse operated solenoids positioned to operate said valve means between open and closed conditions.

8. The apparatus of claim 7 wherein said solenoids operate a pilot valve having two operative conditions and said pilot valve has a valve element responsive to solenoid operation, and said pilot valve includes means holding said valve element in the position achieved on last operation of said solenoids.

9. The apparatus of claim 8 wherein said pilot valve is a two position, three way valve having two outlet lines connected to a gas supply line control valve.

10. For use in controlling production of a producing well on a gas lift system in response to pressure in the casing and pressure in the production tubing in the well which are determined by pressure sensor means forming signals indicative of the pressures thereof, an apparatus which comprises a DC powered controller connected to test the well pressure signals from said sensor means, and further including output means connected to said controller for forming a control signal for operation of the gas lift system and wherein said controller includes an integrated circuit microcomputer means switched on by a first means preventing application of adequate power for operation cooperative with a second means periodically switching said microcomputer means on for an interval of time sufficient to operate a third means to obtain signals indicative of the well pressure, and wherein said microcomputer means is on sufficiently long to determine operation of the well dependent on the well pressure to form control signals from said output means.

11. For use in controlling the rate of production of a producing well having a gas lift system operative in response to pressures of the well which are determined by sensor means forming well pressure signals indicative thereof, an apparatus which comprises a battery powered microcomputer to test the well pressure signals from said sensor means, and further including output means connected to said microcomputer for forming a control signal for operation of the gas lift system and wherein said output means comprises a control valve for lift gas supplied to said valve and wherein microcomputer is switched on by a first means preventing application of adequate power for operation cooperative with a second means periodically switching said microcomputer means on for an interval of time sufficient to operate a third means to obtain signals indicative of well pressures, and wherein said microcomputer determines operation of the well dependent on the well pressures and forms control signal.

* * * * *